US006746302B2

(12) United States Patent
Morikawa

(10) Patent No.: US 6,746,302 B2
(45) Date of Patent: Jun. 8, 2004

(54) WINDUP SPRING DRIVE UNIT

(75) Inventor: Ryota Morikawa, Saitama (JP)

(73) Assignee: Seikoken Kabushiki Kaisha, Saitama (JP)

( * ) Notice: Subject to any disclaimer, the term of this patent is extended or adjusted under 35 U.S.C. 154(b) by 0 days.

(21) Appl. No.: 10/439,757

(22) Filed: May 16, 2003

(65) Prior Publication Data

US 2004/0002285 A1 Jan. 1, 2004

(30) Foreign Application Priority Data

May 21, 2002 (JP) ..... 2002-146212

(51) Int. Cl.[7] ..... A63H 29/00

(52) U.S. Cl. ..... 446/353; 446/457

(58) Field of Search ..... 446/354, 355, 446/356, 457, 464, 353, 352, 330; 185/39, 45, DIG. 1

(56) References Cited

U.S. PATENT DOCUMENTS

| | | | | | |
|---|---|---|---|---|---|
| 4,455,783 A | * | 6/1984 | Nagano | ..... | 446/71 |
| 5,103,936 A | * | 4/1992 | Morikawa | ..... | 185/39 |
| 5,628,668 A | | 5/1997 | Takemae | | |

* cited by examiner

*Primary Examiner*—Jacob K. Ackun, Jr.
(74) *Attorney, Agent, or Firm*—Notaro & Michalos PC

(57) ABSTRACT

A windup spring drive unit improving the operability of winding when incorporated in an apparatus such as a toy, and increasing a degree of freedom in design. The windup spring drive unit comprises: a spring 2 as a power source; a windup shaft 3 which manually winds up the spring 2; an output shaft 4; and a gear train 5 which transmits the power of the spring 2 to the output shaft 4, these members being accommodated in a casing 6. A crown gear 8 is included in the gear train 5, the crown gear 8 has its center of rotation axis being arranged in parallel with the windup shaft 3. The output shaft 4 and the windup shaft 3 are arranged to be orthogonal to each other, and the windup shaft 3 is provided to pierce in a thin direction t of the casing 6.

7 Claims, 5 Drawing Sheets

WINDUP SPRING DRIVE UNIT

TECHNICAL FIELD

The present invention relates to a windup spring drive unit for manually winding up a spring. More particularly, the present invention relates to a windup spring drive unit suitable for being mounted in a toy such as a car or a doll.

BACKGROUND ART

A conventional windup spring drive until 101 having a spring as a power source includes, e.g., a spring 102 which is a power source, a windup shaft 103 to wind up the spring 102, an acceleration gear train 105 which transmits rotations of the windup shaft 103 to an output shaft 104, a constant speed mechanism 106 which makes rotations of the output shaft 104 constant, and a casing 107 which accommodates these members therein, as shown in FIG. 5. In the spring drive until 101, the spring 102 is manually wound by pinching and turning a knob (not shown) provided to the windup shaft 103. further, by letting go of the pinched knob and releasing the windup shaft 103, the stored power of the spring 102 is transmitted to the acceleration gear train 105 and causes the output shaft 104 to rotate. Furthermore, the acceleration gear train 105 is also interlinked with the constant speed mechanism 106 and maintains constant-speed rotations of the output shaft 104.

Here, the windup shaft 103 and the output shaft 104 are arranged in parallel with each other and provided so as to transmit rotations through the acceleration gear train 105 consisting of only spur gears. Therefore, the casing 107 is formed into a flat rectangular shape which is thin in the axial direction of both the windup shaft 103 and the output shaft 104.

When this spring drive unit 101 is included and used in a toy such as an animal type toy or a character doll which involves movements, e.g., a walking doll 108 as shown in FIG. 6, the output shaft 104 is arranged in the right-and-left direction because of the relationship with right and left hands 112 or legs (not shown) of the walking doll 108 to be driven. Moreover, when this spring drive unit 101 is included in, e.g., a car toy 109 such as shown in FIG. 7, the output shaft 104 is arranged in the right-and-left direction (parallel to a floor) because of the relationship with tires 110 as targets to be driven.

In the above-described conventional windup spring drive unit 101, however, the windup shaft 103 and the output shaft 104 are parallel to each other, and all the components, i.e., the gears and the spring are arranged in parallel with the both shafts 103 and 104. Therefore, the gear unit takes up less space in the axial direction of the both shafts 103 and 104 and much space in a direction orthogonal to the axial direction (height direction of the gear unit). For example, when the drive unit is included in the walking doll 108, it is set in the height direction of the gear unit on the front and back sides, and hence the doll has a stockily-built figure/shape that the front and back sides of the doll are expanded. In addition, when the drive unit is included in a car toy 109, it is set with the height direction of the casing 107 being determined as a vehicle height direction, which increases the vehicle height as a whole. Thus, in case of the walking doll 108, its shape must be deformed so as to be thicker in the front-and-back direction than an actual human. Additionally, in case of the car toy 109, its shape must be deformed so as to increase the vehicle height as compared with an actual automobile, and the toy must be designed far from the shape of an actual automobile, which restricts a degree of freedom in design.

Further, since the windup shaft 103 is parallel with the output shaft 104, the windup knob 111 and arms of the doll 112 are positioned close to each other when the drive unit is incorporated in the walking doll 108 or the like. This complicates the winding operation of the spring 102, and causing the knob to largely protrude generates a problem of the unnecessary bulkiness. Furthermore, there also occurs a problem that existence of the knob protruding to the side of the doll restricts the movement or the set positions of the arms. Therefore, when the drive unit is mounted in the car toy 109, since the knob 111 protrudes to the side of the car body, a sufficient space to pinch and wind the knob cannot be obtained between the knob and a traveling surface such as a floor, and hence the operation to wind the spring 102 while pressing the tires 110 against the floor or rails is difficult. Thus, the knob 111 must be rotated while lifting the car toy 109 and holding the tires 110 so as not to run idle, which makes the winding operation of the spring difficult. In particular, in case of the car toy which runs on the rails, although it is desired to enable winding of the spring with the car toy 109 set on the rails, the operability of the knob 11 in that state is so poor that improvement on this problem demanded.

Moreover, since the windup knob 111 must protrude in the vicinity of the arm 112 of the doll or to the side of the car body in the vicinity of the traveling surface for the car toy, the design in toys may be considerably restricted in some cases, which complicates the design.

It is, therefore, an object of the present invention to provide a windup spring drive unit which can improve the operability of winding when incorporated in an apparatus such as a toy and increase a degree of freedom in design of toys.

DISCLOSURE OF INVENTION

To achieve this aim, according to the present invention defined in the claims, there is provided a windup spring drive until comprising: a spring which is a power source; a windup shaft which manually winds up the spring; an output shaft; and a gear train which transmits the power of the spring to the output shaft, these members being accommodated in a casing, wherein a crown gear provided in such a manner that its center of rotational axis is parallel with the windup shaft is included in a gear train so that the output shaft and the windup shaft are arranged to be orthogonal to each other, and the windup shaft is caused to pierce in a thin direction of the casing.

Therefore, since the output shaft and the windup shaft are arranged so as to be orthogonal to each other, the windup shaft/knob can be set on a surface different from a surface from which the output shaft protrudes when the spring drive unit is mounted in an apparatus such as a toy. Accordingly, the interference between the windup knob and the output shaft can be avoided, and the operability when winding the spring can be improved. Also, a degree of freedom in the movement or the set positions of members driven by the output shaft can be increased, the restriction in design of the prior art can be reduced, and the new design or movement can be given to toys.

BEST MODE FOR CARRYING OUT OF THE INVENTION

Figure 1:
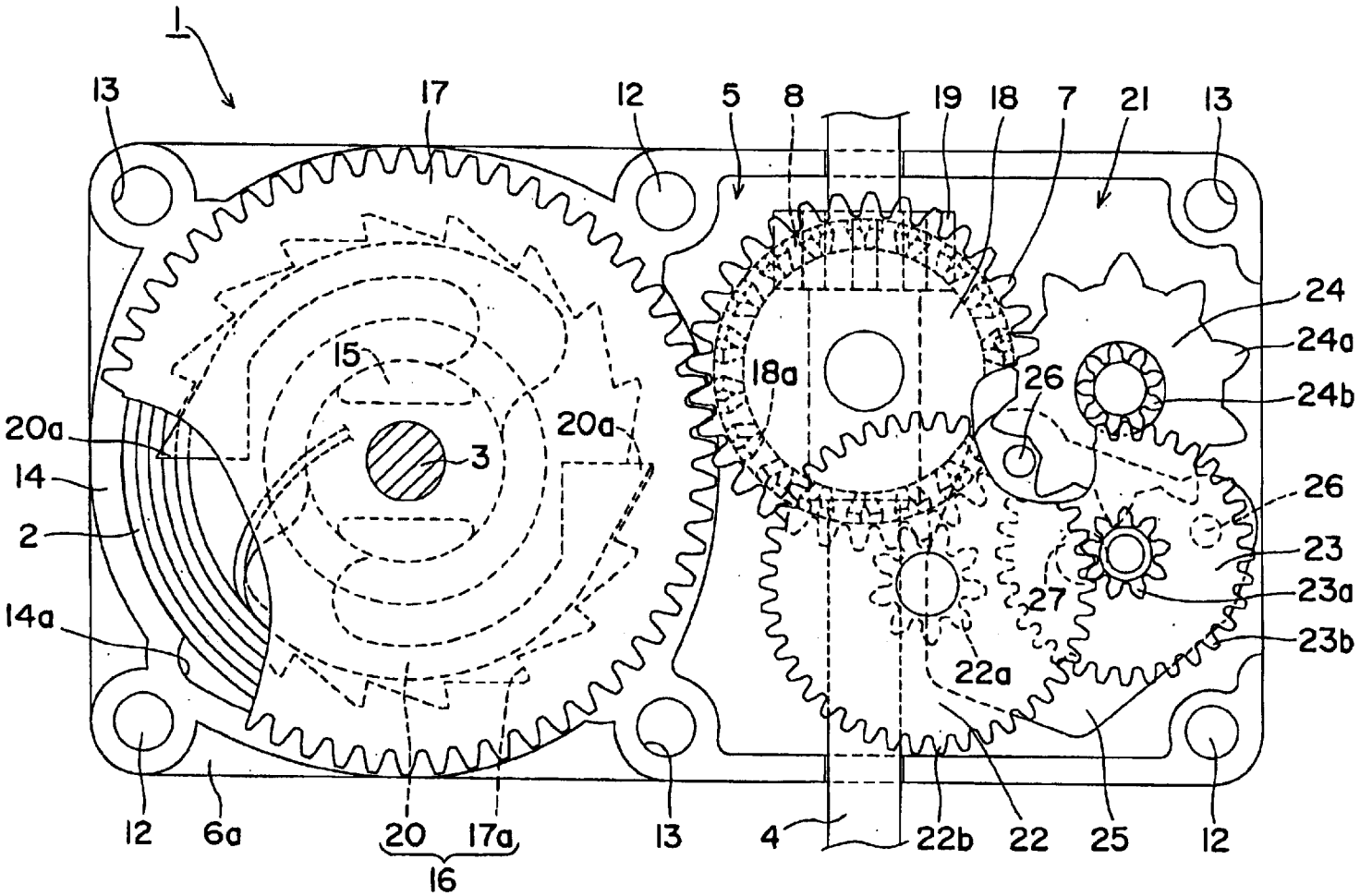
FIG. 1 is a plane view showing an internal structure of a windup spring drive unit according to the present invention.
Figure 2:
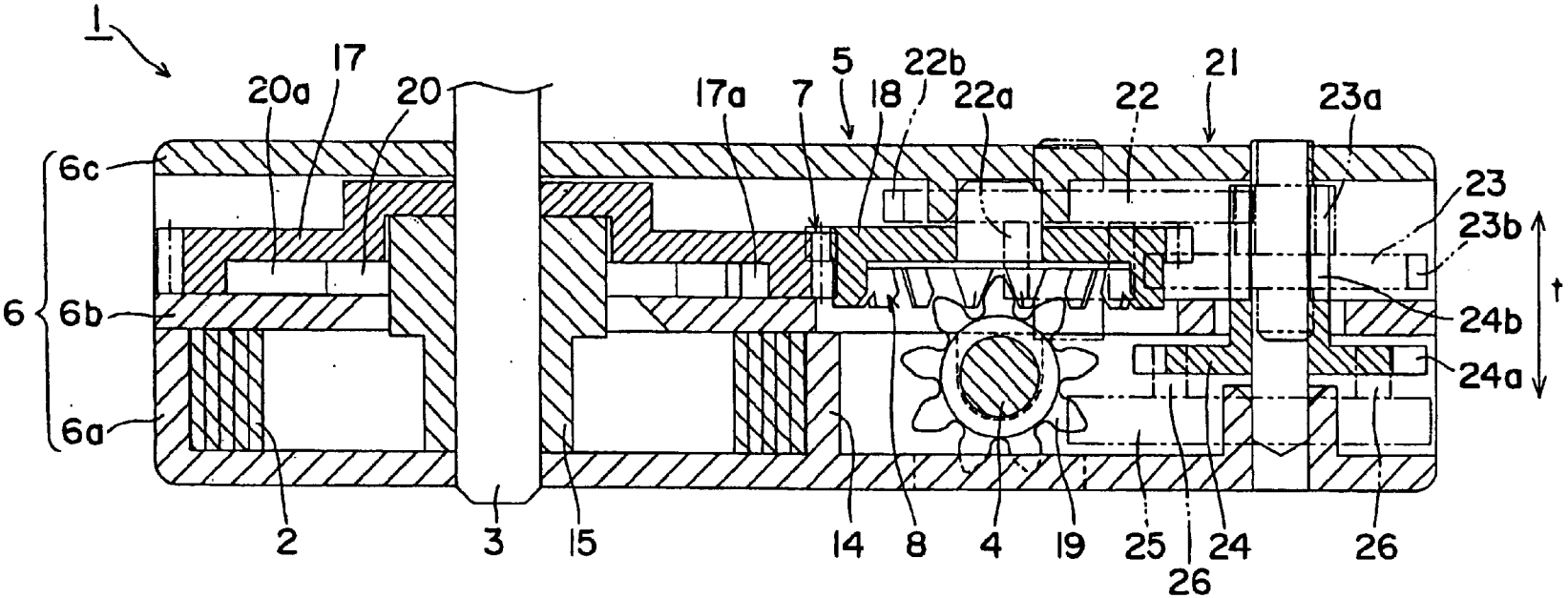
FIG. 2 is a side view showing the internal structure of the windup spring drive unit.

The structure of the present invention will now be described in detail hereinafter based on the illustrated best mode.

FIGS. 1 to 4 show an embodiment of a windup spring drive unit 1 according to the present invention. This windup spring drive unit (which will be simply referred to as a spring drive unit hereinafter) 1 is configured to accommodate in a casing 6 a spring 2 which is a power source, a windup shaft 3 which manually winds the spring 2, an output shaft 4, a gear train 5 which transmits the power of the spring 2 to the output shaft 4, and a constant speed mechanism 21 which damps rotations of the output shaft 4 and thereby obtains a constant speed. Further, the output shaft 4 and the windup shaft 3 are arranged to be orthogonal to each other by including in the gear train 5 a crown gear 8 provided in such a manner that its center of rotational axis is arranged in parallel with the windup shaft 3, and the windup shaft 3 is caused to pierce in the thin direction of the casing 6. Therefore, when this spring drive unit 1 is mounted in an apparatus 9 or 10 such as a toy, a windup knob 11 can be set on a surface different from a surface from which the output shaft 4 protrudes. Therefore, the interference between the windup knob 11 and the output shaft 4 can be avoided, and the operability when winding the spring 2 can be improved. Also, a degree of freedom in movement or set positions of members driven by the output shaft 4 can be increased.

The output shaft 4 and the windup shaft 3 are arranged so as to be orthogonal to each other. In this embodiment, the crown gear 8 is integrally formed to a second gear 18 which meshes with a so-called a first gear 17 which is arranged coaxially with the windup shaft 3, and the output shaft 4 is arranged coaxially with a pinion gear 19 which meshes with the crown gear 8. With this arrangement, the respective shafts 3 and 4 are set at the positions orthogonal to each other when seen from an extension line of a minimum distance connecting the respective shafts 3 and 4 with each other. Therefore, since both ends of the output shaft 4 and the windup shaft 3 can be provided so as to be furthermost from each other, the operability when winding the spring 2 can be improved. Further, the output shaft 4 is arranged so as to pierce in a direction orthogonal to a thin direction (which will be referred to as a thickness direction t) of the casing 6 having a fiat rectangular shape, i.e., a casing widthwise or wide direction. Therefore, when the spring drive unit 1 is mounted in the apparatus 9 or 10, a direction along which the windup shaft 3 is taken out can be changed from the prior art by 90 degrees, and hence the apparatus 9 or 10 having a completely novel design can be obtained.

Here, the casing 6 is constituted by a first casing 6*a* and a third casing 6*c* which can be separated from each other and a second casing 6*b* which partitions the casings 6*a* and 6*c*, and they are separably coupled by fitting a pin 12 to a hole 13 which are integrally molded to the casings 6*a* and 6*c* on the both sides. A through hole (not shown) into which the pin 12 is inserted is provided to the second casing 6*b*, and the casing 6 is assembled by fitting the pin 12 to the hole 13 via the through hole so as to be capable of being disassembled. It is to be noted that the spring 2 is accommodated in a space between the first casing 6*a* and the second casing 6*b*.

A peripheral wall 14 which surrounds the spring 2 from the radial direction is provided to the first casing 6*a*. At least one concave portion 14*a* is formed to the peripheral wall 14. At the outer end portion of the spring 2, the end is bent to form a circular or triangular engagement convex portion (not shown) which faces the outside. The engagement convex portion is constantly pushed to the outer side in the radial direction by the elastic force of the spring 2, fitted in the convex portion 14*a*, and causes the outer end of the spring 2 to engage with the peripheral wall 14 by the frictional force. Furthermore, the inner end portion of the spring 2 is wound around a spring stopper claw 15 of the windup shaft 3, and the spring 2 is wound up by rotation of the windup shaft 3. It is to be noted that the engagement structure of the spring which is generally called a bump type is described in this embodiment but the present invention is not restricted thereto. For example, it is possible to adopt an engagement structure which is generally called a hook type that one end of the spring is hooked on a frame.

The gear train 5 includes a first gear 17 interlinked with the windup shaft 3 through a clutch 16, a second gear 18 which meshes with the first gear 17, and a pinion 19 which meshes with the second gear 18 to change the rotational axis by 90 degrees and is also fitted to the output shaft 4. To the second gear 18 are integrally formed on the same axis a spur gear 7 which meshes with the first gear 17 and a crown gear 8 which meshes with the pinion 19. The crown gear 8 is used to change the rotational axis by 90 degrees, and the output shaft 4 is arranged so as to be orthogonal to the rotational axis of the second gear 18 on the cross-sectional plane on the same axis. The crown gear 8 does not have to be provided on the second gear like this embodiment, and it may be provided to the third or following gears in some cases. However, when it is provided to the second gear, the largest running torque can be advantageously obtained.

The clutch 16 interlinking the windup shaft 3 with the first gear 17 is constituted by a reversed-S-shaped arm 20 fixed to the windup shaft 3 by press fitting or the like, and a saw-tooth-like internal tooth 17*a* which is formed to the first gear 17 and with which a tip 20*a* of the arm 20 engages when the arm 20 rotates in the releasing direction of the spring 2. Therefore, the clutch 16 enters the disconnected state and stops transmission of the turning force to the first gear 17 when winding up the spring and, on the other hand, it enters the connected state and transmits the turning force to the first gear 17 when releasing the spring. It is to be noted that the arm 20 and the spring stopper claw 15 are made of plastic and formed by integral molding in this embodiment.

Furthermore, a constant speed mechanism 21 which maintains the constant speed rotation of the output shaft 4 is interlinked with the gear train 5. The constant speed mechanism 21 includes a third gear 22 which meshes with a gear 7 provided on the outer peripheral surface of the second gear 18, a fourth gear 23 which meshes with the third gear 22, a fifth gear 24 which meshes with the fourth gear 23 and has a star gear 24*a*, and a second 25 which abuts on the star gear 24*a*. Therefore, rotation of the second gear 18 (gear 7) is transmitted from the gear 7 to the pinion 22*a* of the third gear 22, a large-diameter gear 22*b* of the third gear 22, the pinion 23*a* of the fourth gear 23, the large-diameter gear 23*b* of the fourth gear 23, the pinion 24*b* of the fifth gear 24 and the start gear 24*a* in the mentioned order. The second 25 alternately brings two pins 26 at a bifurcate portion into contact with teeth of the star gear 24*a* and oscillates around a pin 27. Moreover, the second 25 is provided in such a manner that the star gear 24*a* rotates only when the second 25 is oscillating. That is, since rotation of the star gear 24*a* is under the control of oscillation of the second 25, the rotational speed of the output shaft 4 is maintained at a constant speed.

The operation of the above-described spring drive unit 1 will now be described hereunder.

When the spring 2 is not sufficiently wound up, the engagement convex portion fits in the concave portion 14*a* by the elastic force of the spring 2, and engages the outer end portion of the spring 2 by the frictional force.

When the spring 2 is sufficiently taken up, the spring 2 is wound up so as to move away from the peripheral wall 14, and the engagement convex portion at the outer end which is fitted in the convex portion 14*a* can be deformed inwards, gets over the concave portion 14*a* by the force to wind up the spring 2 and moves along the peripheral wall 14. As a result, the spring 2 runs idle together with the windup shaft 3, thereby preventing excessive windup.

When the spring 2 is wound up and then released, the releasing force of the spring 2 is transmitted to the first gear 17 through the clutch 16, and rotates the output shaft 4 via the crown gear 8 of the second gear 18 and the pinion 19. On the other hand, rotation of the second gear 18 is used to turn the third gear 22 of the constant speed mechanism 21 via the gear 7, restricts free rotation of the second gear 18, and maintains a constant speed.

Figure 3:
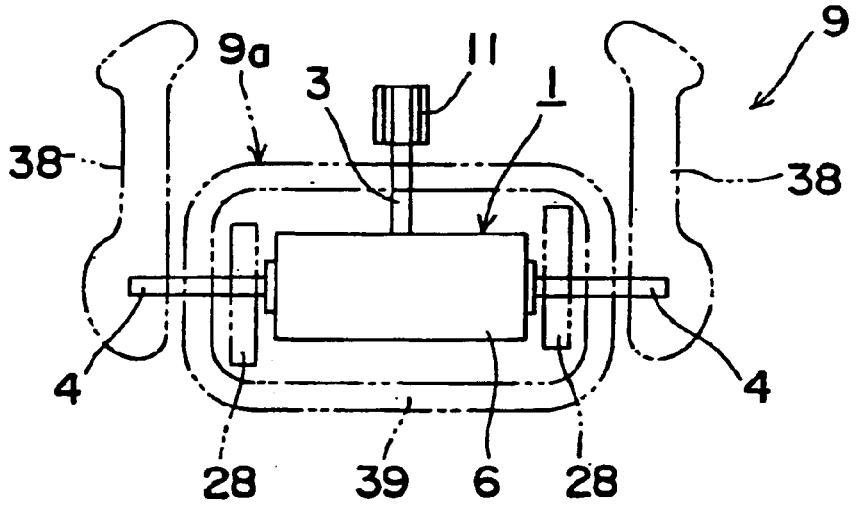
FIG. 3 is a transverse cross-sectional plane view showing a state that the windup spring drive until is mounted in a walking doll.

Here, description will be given as to a case that the above spring drive unit 1 is mounted in a walking doll 9. In this case, as shown in FIG. 3, the windup shaft 3 can be provided in the front-and-back direction while arranging the output shaft 4 in the right-and-left direction of the walking doll 9. Here, although the windup shaft 3 is caused to protrude from a back surface 9*a* of a body 39 of the walking doll 9, it may be caused to protrude from a front surface in some cases. In addition, a windup knob 11 is provided at the tip of the windup shaft 3. In the drawing, reference numeral 28 denotes a crank used to move legs of the walking doll 9 back and forth.

Figure 6:
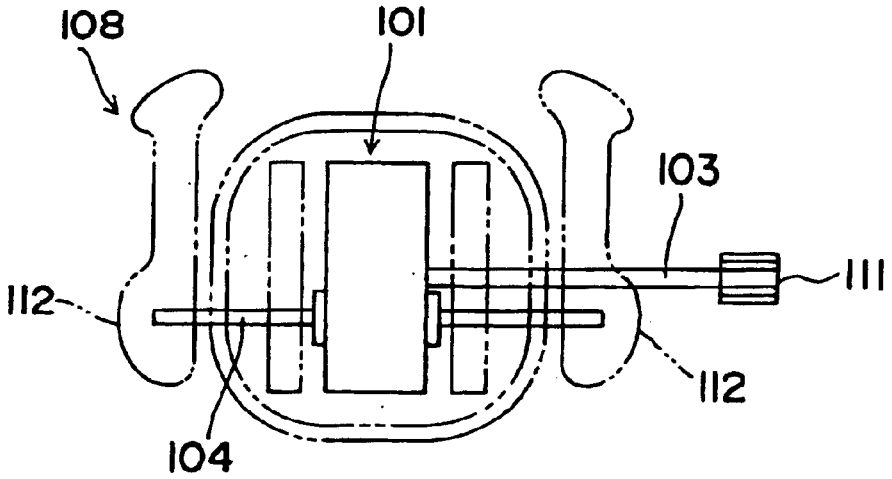
Fig. 6 (PRIOR ART)
FIG. 6 is a transverse cross-sectional plane view showing a state that the prior art windup spring drive unit is mounted in a walking doll.

According to this embodiment, since the windup shaft 3 protrudes from the back surface 9*a* of the body 39 of the walking doll 9, arms 38 of the walking doll 9 and the windup knob 11 can be prevented from interfering with each other. Therefore, the arms 38 of the walking doll 9 can be moved irrespective of the windup knob 11 and hence a degree of freedom in design of the arms can be increased as compared with a case that one arm and the windup knob 11 interfere with other and the movement of the arm is largely restricted like the prior art walking doll 108 shown in FIG. 6. Additionally, since the arm cannot be an obstacle during winding, winding can be facilitated and the operability can be enhanced.

Further, the thickness direction t of the casing 6 can be set in the front-and-back direction by providing the output shaft 4 in the right-and-left direction, thereby obtaining the walking doll 9 which is thin in the front-and-back direction. Therefore, as compared with a doll like the conventional walking doll 108 in which the thickness direction of the casing must be set in the right-and-left direction and which has a deformed figure being thick in the front-and-back direction, it is possible to obtain the thin and small walking doll 9 having a figure close to that of an actual human.

It is to be noted that the above-described conformation is a preferred embodiment of the present invention but the present invention is not restricted thereto, and various modifications can be carried out without departing from the scope of the present invention. For example, although description has been mainly given as to the spring drive unit 1 having the constant speed mechanism 21 in connection with this embodiment, constant-speed rotation can be realized by the pendulum service based on the relationship with a cam used to cause the pendulum service, legs or hands in case of a toy which causes the pendulum service by the driven side, i.e., hands or legs of the walking doll, and hence the constant speed mechanism 21 is no longer necessary in the unit 1. Furthermore, when the spring drive unit is mounted in a toy car which is caused to travel on rails, the spring cannot be instantaneously released by a weight or the like of the car and, even if the spring is instantaneously released, the car continues traveling by the inertia force obtained by this release, which results in no problem. Therefore, the constant speed mechanism 21 does not have to be necessarily provided.

Figure 4:
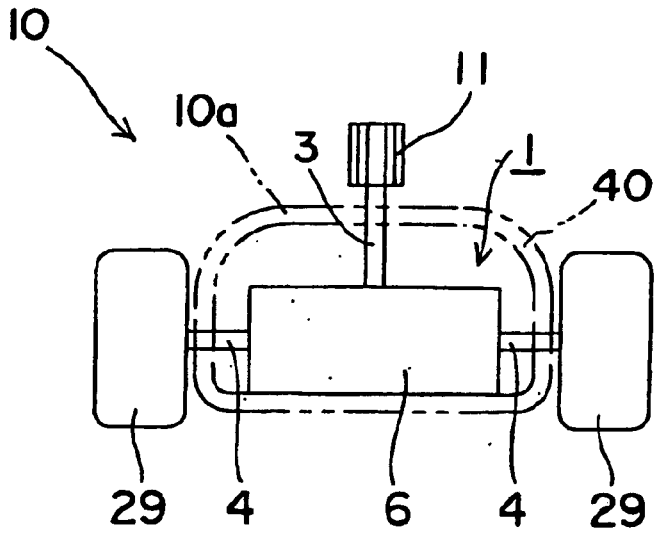
FIG. 4 is a vertical cross-sectional front view showing a state that the windup spring drive until is mounted in a car toy.
Figure 5:
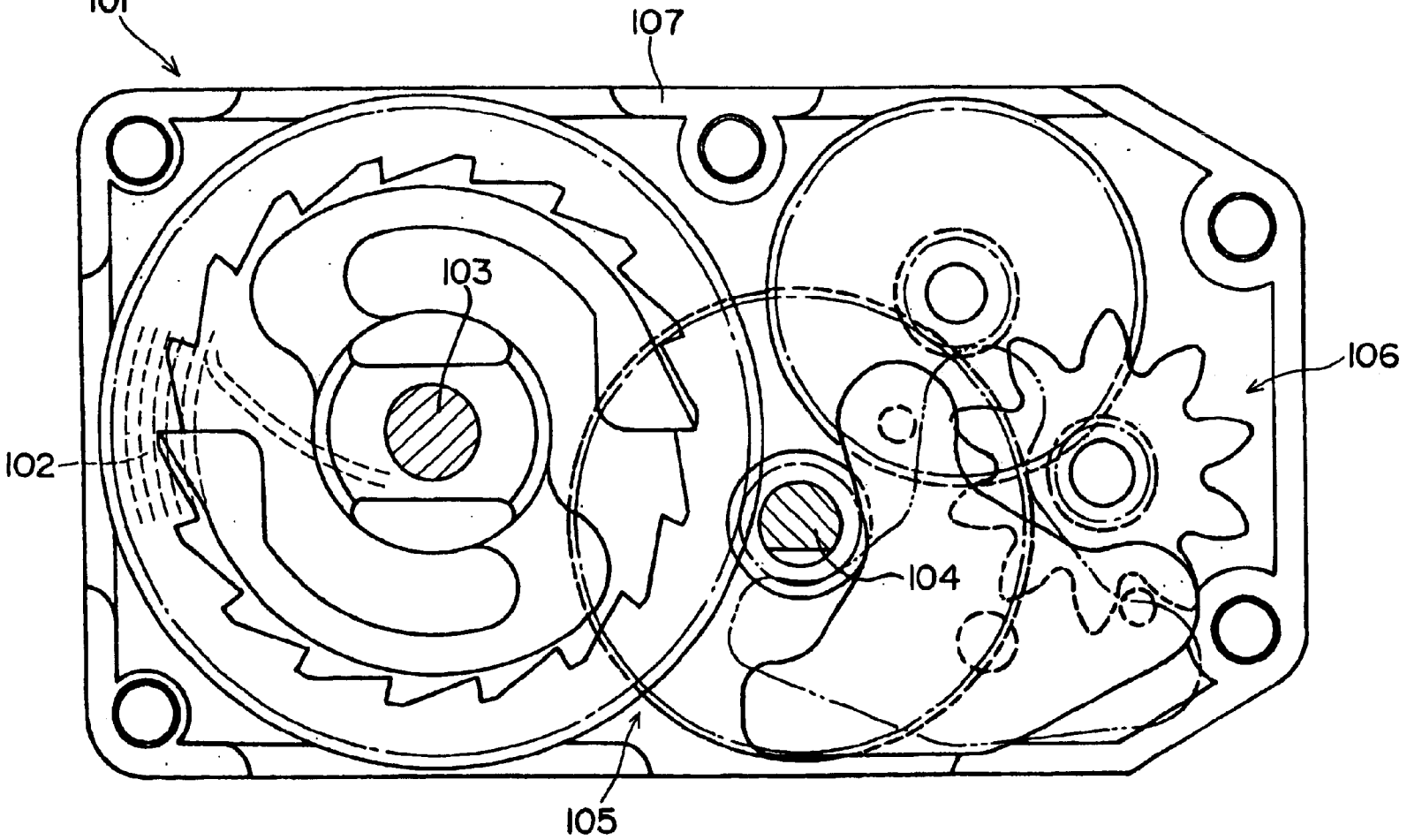
Fig. 5 (PRIOR ART)
FIG. 5 is a plane view showing an internal structure of a prior art windup spring drive until.

Moreover, although the spring drive unit 1 is mounted in the walking doll 9 in this embodiment, the present invention is not restricted thereto, and the spring drive unit 1 may be mounted in, e.g., a toy car 10 as shown in FIG. 4. When the spring drive unit 1 is mounted in the toy car 10, the output shaft 4 can be set in the right-and-left direction (widthwise direction) of a body 40 of the toy car 10 whilst the windup shaft 3 can be provided so as to protrude upwards from the car roof. Here, the windup shaft 3 is caused to protrude from a roof portion 10*a* of the car toy 10. In addition, a windup knob 11 is provided at the tip of the windup shaft 3. Additionally, tires 29 are attached to the output shaft 4.

According to this embodiment, since the windup shaft 3 protrudes from the roof portion 10*a* of the toy car 10, the spring 2 can be wound up from above without lifting up the toy car 10 from the floor. Therefore, the spring 2 can be wound up while putting the car toy 10 on, e.g., rails when moving the toy car 10 on the rails.

Figure 7:
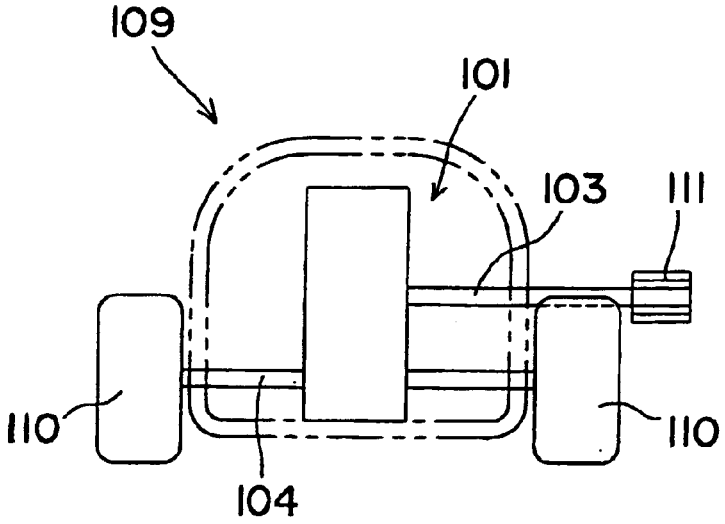
Fig. 7 (PRIOR ART)
FIG. 7 is a vertical cross-sectional front view showing a state that the prior art windup spring drive unit is mounted in a toy car.

Further, when the output shaft 4 is set in the right-and-left direction, the casing 6 can be simultaneously provided with its thickness direction t being set in the up-and-down direction. Therefore, the toy car 10 with a low vehicle height can be obtained. As a result, as compared with a toy car like the conventional toy car 109 shown in FIG. 7 that the thickness direction of the casing must be set in the right-and-left direction and the vehicle height is thereby increased, the toy car 10 having a shape close to that of an actual car can be obtained.

Although the spring drive unit 1 is mounted in the walking doll 9 or the toy car 10 in the above-described embodiment, it is needless to say that the present invention is not restricted thereto.

Furthermore, although the output shaft 4 is orthogonal to the thickness direction t of the casing 6 in the above-described embodiment, the output shaft 4 and the windup shaft 3 may take the positional relationship of distortion so as to form an angle (excluding parallelism) other than the right angle. Here, "the output shaft and the windup shaft are placed at positions of distortion" means that both of the shafts have the positional relationship other than parallelism, and includes a case that the both shafts do not cross each other as well as a case that the both shafts cross each other.

Moreover, although the output shaft 4 and the windup shaft 3 are placed at positions where they are orthogonal to each other when seen from an extension line of a minimum distance connecting the respective shafts with each other in the above-described embodiment, they may be set so as to have the positional relationship of distortion other than orthogonal relationship by utilizing a combination of angular bevel gears in place of a combination of the crown gear 8 and the pinion 19 in some cases.

As described above, according to the windup spring drive unit of the present invention, since the output shaft and the windup shaft are positioned so as to be orthogonal to each other, the windup knob can be provided on a surface different from a surface from which the output shaft protrudes when the spring drive unit is mounted in an apparatus such as a toy. Therefore, the windup knob and the output shaft can be prevented from interfering with each other, and the operability when winding up the spring can be improved. Also, it is possible to increase a degree of freedom in operations or set positions of members moved by the output shaft. That is, since the output shaft and the windup shaft exist in such a manner that their both ends are distanced from each other without overlapping on the same surface, a sufficient space to pinch and rotate the knob can be set even if the knob is provided to the windup shaft, thereby facilitating the windup operation of the spring through the windup shaft. Additionally, since the thickness of the spring drive unit in a direction orthogonal to the output shaft can be reduced, deformation applied to the body of a doll or a toy car in which the spring drive unit is mounted can be decreased, thereby obtaining the novel design.

What is claimed is:

1. A windup spring drive unit having a manually windable spring, comprising: a windup shaft which is arranged coaxially with the spring; an output shaft spaced from the windup shaft; a gear train operatively engaged between the windup shaft and the output shaft for transmitting power of the spring to the output shaft; and a casing having a thin direction and an orthogonal wide direction and which accommodates the windup shaft, the spring, the output shaft and the gear train therein; the gear train including a crown gear, a center of rotation axis of the crown gear being arranged parallel to the windup shaft, the output shaft and the windup shaft being arranged in a crossing and orthogonal positional relationship when seen from a direction along which the output shaft and the windup shaft overlap, one end of the windup shaft protruding in the thin direction of the casing and adapted to protrude by a distance which is sufficient to include means for manually inputting rotation in the windup shaft.

2. The windup spring drive unit according to claim 1, wherein the crown gear is arranged at a position where it meshes with a pinion which is coaxial with the output shaft.

3. The windup spring drive unit according to claim 1, wherein a constant speed mechanism which rotates at a constant speed is provided to the gear train, and the constant speed mechanism meshes with a gear portion provided at an outer periphery of the crown gear.

4. The windup spring drive unit according to claim 3, wherein the casing has a first casing and a second casing which can be separated from each other and a third casing which partitions the first and second casings and forms two spaces, the spring and the crown gear being accommodated in one space of the casing, and components of the constant speed mechanism being accommodated in both the two spaces of the casing.

5. The windup spring drive unit according to claim 2, wherein a constant speed mechanism which rotates at a constant speed is provided to the gear train, and the constant speed mechanism meshes with a gear portion provided at an outer periphery of the crown gear.

6. The windup spring drive unit according to claim 5, wherein the casing has a first casing and a second casing which can be separated from each other and a third casing which partitions the first and second casings and forms two spaces, the spring and the crown gear being accommodated in one space of the casing, and components of the constant speed mechanism being accommodated in both the two spaces of the casing.

7. A windup spring drive unit having a manually windable spring, comprising: a windup shaft which is arranged coaxially with the spring; an output shaft spaced from the windup shaft; a gear train operatively engaged between the windup shaft and the output shaft for transmitting power of the spring to the output shaft; and a casing having a thin direction and an orthogonal wide direction and which accommodates the windup shaft, the spring, the output shaft and the gear train therein: the gear train including a crown gear, a center of rotation axis of the crown gear being arranged parallel to the windup shaft, the output shaft and the windup shaft being arranged in a crossing and orthogonal positional relationship when seen from a direction along which the output shaft and the windup shaft overlap, one end of the windup shaft protruding in the thin direction of the casing and adapted to protrude by a distance which is sufficient to include means for manually inputting rotation in the windup shaft; wherein the crown gear is arranged in a position where it meshes with a pinion which is coaxial with the upward shaft; the windup spring drive unit including a constant speed mechanism which rotates at a constant speed is provided to the gear train, and the constant speed mechanism meshes with a gear portion provided at an outer periphery of the crown gear; the casing having a first casing and a second casing which can be separated from each other and a third casing which partitions the first and second casings and forms two spaces, the spring and the crown gear being accommodated in one space of the casing and components of the constant speed mechanism being accommodated in both the two spaces of the casing.

* * * * *